US012013206B1

(12) United States Patent
Kung et al.

(10) Patent No.: US 12,013,206 B1
(45) Date of Patent: Jun. 18, 2024

(54) TOY GUN HAVING EMBEDDED MAGAZINE

(71) Applicant: VEGA FORCE INTERNATIONAL CORP., Taoyuan (TW)

(72) Inventors: Shih-Che Kung, Taoyuan (TW); Wei-Hung Chung, Taoyuan (TW)

(73) Assignee: VEGA FORCE INTERNATIONAL CORP., Taoyuan (TW)

( * ) Notice: Subject to any disclaimer, the term of this patent is extended or adjusted under 35 U.S.C. 154(b) by 0 days.

(21) Appl. No.: 18/096,322

(22) Filed: Jan. 12, 2023

(30) Foreign Application Priority Data

Nov. 28, 2022 (TW) ..... 111213114

(51) Int. Cl.

| | |
|---|---|
| ***F41B 7/08*** | (2006.01) |
| ***A63H 33/18*** | (2006.01) |
| ***F41B 7/00*** | (2006.01) |
| ***F41B 11/50*** | (2013.01) |
| *F41B 11/51* | (2013.01) |
| *F41B 11/89* | (2013.01) |

(52) U.S. Cl.
CPC ..... *F41B 7/006* (2013.01); *A63H 33/18* (2013.01); *F41B 11/50* (2013.01); *F41B 11/51* (2013.01); *F41B 11/89* (2013.01)

(58) Field of Classification Search
CPC ..... F41B 7/006; F41B 11/50; F41B 11/51; F41B 11/70; F41B 11/89; F41B 11/52; F41A 9/61; A63H 33/18
See application file for complete search history.

(56) References Cited

U.S. PATENT DOCUMENTS

| | | | | |
|---|---|---|---|---|
| 4,241,716 | A * | 12/1980 | Tsui | F41B 7/006 124/39 |
| 6,220,237 | B1 * | 4/2001 | Johnson | F41B 11/89 124/75 |
| 2015/0211827 | A1 * | 7/2015 | Boza | F41B 11/55 29/401.1 |
| 2020/0300575 | A1 * | 9/2020 | Zuo | A63H 33/18 |

* cited by examiner

*Primary Examiner* — John E Simms, Jr.
(74) *Attorney, Agent, or Firm* — Chun-Ming Shih; HDLS IPR SERVICES

(57) ABSTRACT

A toy gun having embedded magazine includes: a gun body having a bullet feeding slot; a top magazine cover pivotally connected at a top end of the gun body and having an accommodating slot and a first latching structure disposed on one side facing the gun body, the first latching structure is located at one lateral side of the accommodating slot; and a magazine assembly detachably disposed in the accommodating slot and having a main body, the main body has a bullet discharging funnel and a second latching structure, the second latching structure is correspondingly latched with the first latching structure; when the top magazine cover pivotally rotates from top to down to cover on top of the gun body, the bullet discharging funnel is correspondingly disposed in the bullet feeding slot. Accordingly, the magazine is embedded and hidden in the top magazine cover.

10 Claims, 7 Drawing Sheets

TOY GUN HAVING EMBEDDED MAGAZINE

BACKGROUND OF THE DISCLOSURE

Technical Field

The present disclosure relates to a toy gun, especially to a toy gun having embedded magazine.

Description of Related Art

With the development of traditional industries, the design and production of a toy gun is in a trend of simulating a real gun, thus more details are pursued by users. However, a magazine of a related-art toy gun, for example a rifle or a machine gun, is mostly disposed at an outer side of a gun body or connected to the gun body like a bullet chain, thus the user may feel a bit hard to move around when the user has a toy gun in hands, and the mobility of the user is affected. Moreover, the magazine or the bullet chain being exposed may increase the risks of being damaged. As such, how to embed the magazine in the gun body and make the magazine be easily detached or installed needs to be improved.

Accordingly, the applicant of the present disclosure has devoted himself for improving the mentioned shortages.

SUMMARY OF THE DISCLOSURE

The present disclosure is to provide a toy gun having embedded magazine, in which a magazine is embedded and hidden in an inner side of a top magazine cover and prevented from being exposed from a gun body, and the magazine is easily detached or installed by a user.

Accordingly, the present disclosure provides a toy gun having embedded magazine, which includes a gun body, a top magazine cover and a magazine assembly. The gun body has a bullet feeding slot. The top magazine cover is pivotally connected at a top end of the gun body and has an accommodating slot and a first latching structure disposed on one side facing the gun body. The first latching structure is located at one lateral side of the accommodating slot. The magazine assembly is detachably disposed in the accommodating slot and has a main body, a bullet discharging funnel is disposed at one side of the main body away from the top magazine cover. The main body has a second latching structure. The second latching structure is correspondingly latched with the first latching structure. When the top magazine cover pivotally rotates from top to down to cover top of the gun body, the bullet discharging funnel is correspondingly accommodated in the bullet feeding slot.

According to one embodiment of the present disclosure, a latching slot arranged corresponding to the first latching structure is disposed at one side of the top magazine cover facing the gun body, the magazine assembly further has a sliding block, a fastening member and an elastic member, the sliding block is disposed on the main body and extended with a latching segment protruding from the main body, the latching segment is correspondingly latched with the latching slot, the sliding block has an elongated hole, the fastening member passes through the elongated hole and is fastened on the main body, a stopping block is disposed at one side of the main body facing the top magazine cover, the sliding block covers the stopping block, and the elastic member elastically abuts between the stopping block and an inner wall of the sliding block.

According to one embodiment of the present disclosure, the first latching structure is a fastening slot, the second latching structure is a protrusion, and the protrusion is correspondingly fastened with the fastening slot.

According to one embodiment of the present disclosure, the first latching structure is a protrusion, the second latching structure is a fastening slot, and the fastening slot is correspondingly fastened with the protrusion.

According to one embodiment of the present disclosure, the main body has a pulling piece, the pulling piece is extended from one side of the main body away from the top magazine cover and located at the same side surface with the second latching structure.

According to one embodiment of the present disclosure, the main body has a pulling piece, the pulling piece is extended from one side of the main body away from the top magazine cover and extended toward a direction away from the second latching structure.

According to one embodiment of the present disclosure, an outer edge of the pulling piece is in a teeth shape.

Advantages achieved by the present disclosure are as follows. The magazine of the toy gun is easily disposed in or detached from the accommodating slot at the inner side of the top magazine cover, thus the magazine is not exposed from the gun body, and the magazine may be easily removed or installed by a user.

BRIEF DESCRIPTION OF THE DRAWINGS

The features of the disclosure believed to be novel are set forth with particularity in the appended claims. The disclosure itself, however, may be best understood by reference to the following detailed description of the disclosure, which describes a number of exemplary embodiments of the disclosure, taken in conjunction with the accompanying drawings, in which:

DETAILED DESCRIPTION OF THE DISCLOSURE

Figure 1:
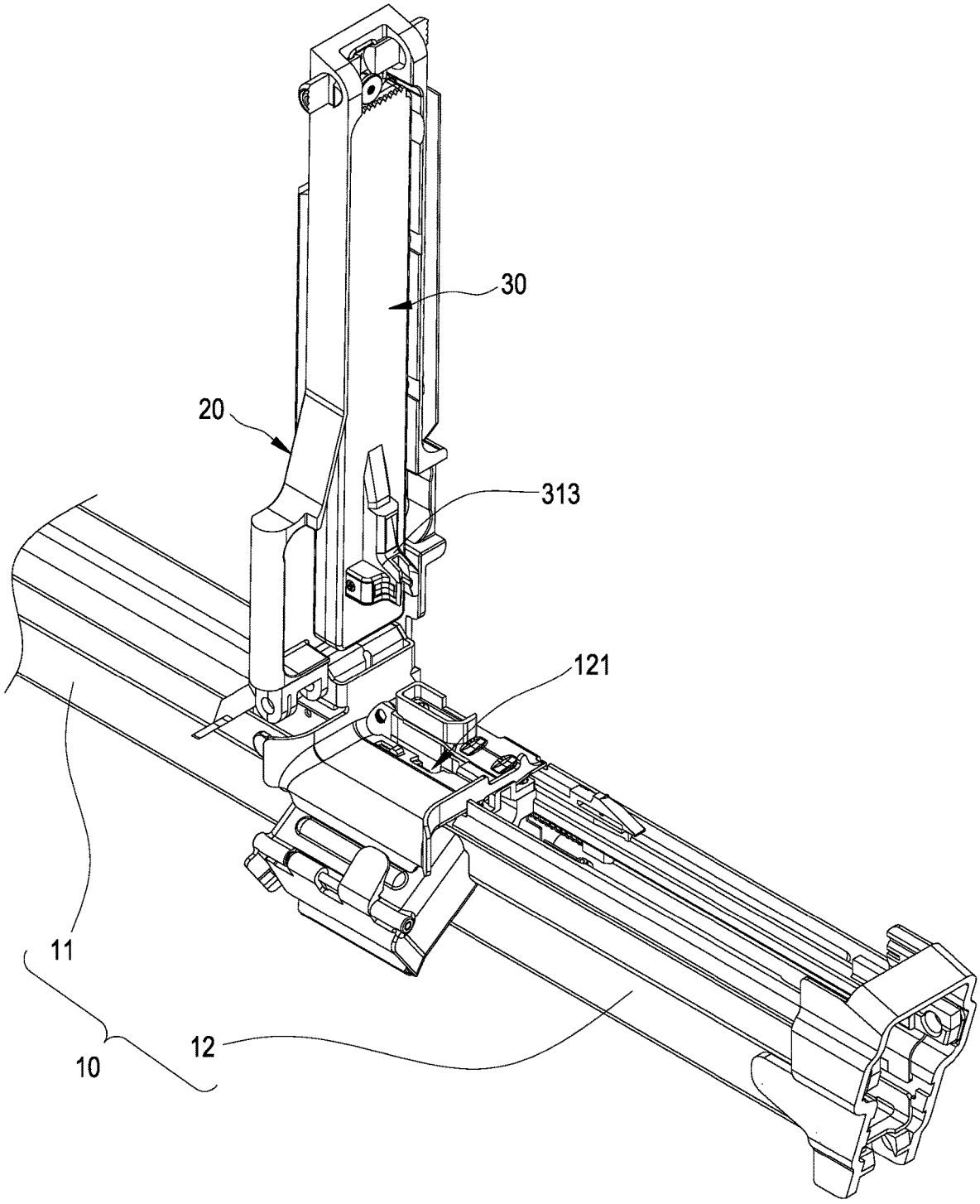
FIG. 1 is a perspective view showing the assembly of the top magazine cover being in an opened status according to the present disclosure.
Figure 2:
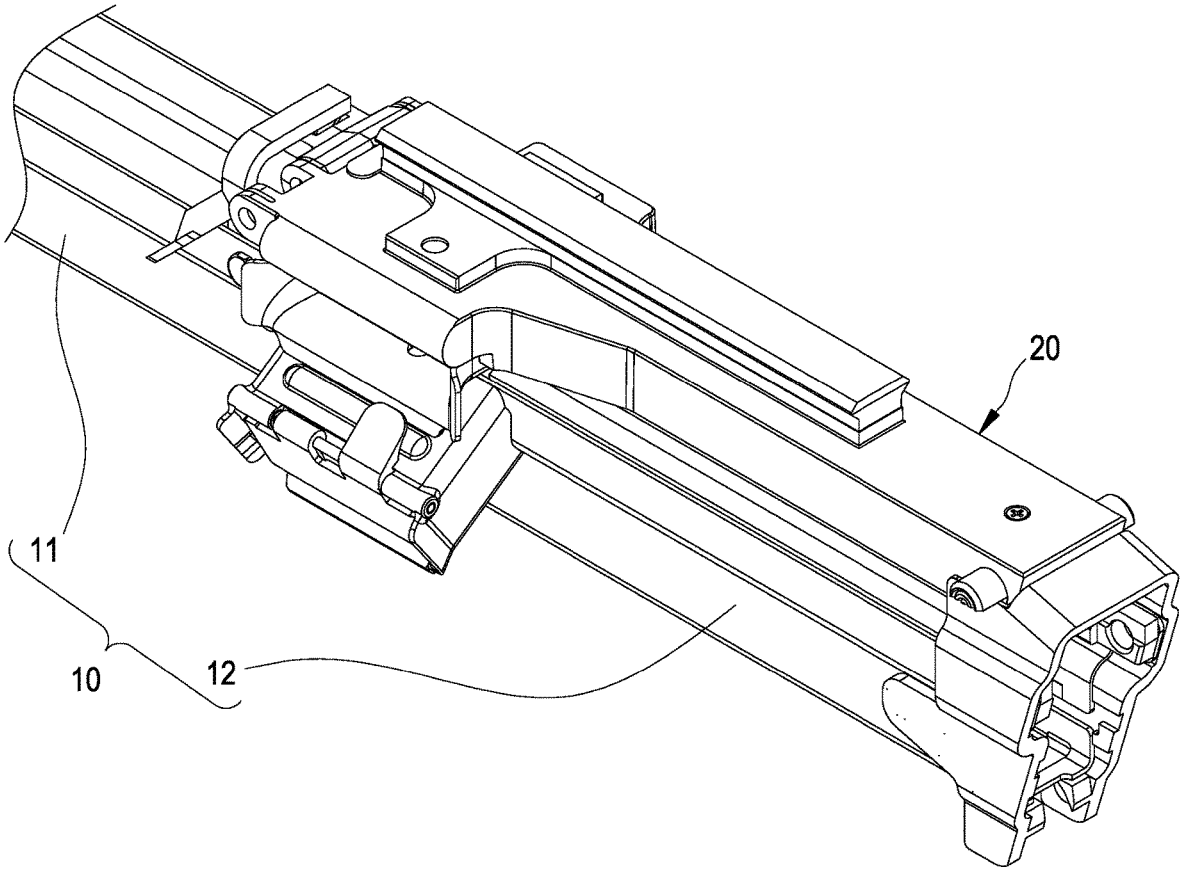
FIG. 2 is a perspective view showing the assembly of the top magazine cover being in a closed status according to the present disclosure.

The technical contents of this disclosure will become apparent with the detailed description of embodiments accompanied with the illustration of related drawings as follows. It is intended that the embodiments and drawings disclosed herein are to be considered illustrative rather than restrictive.

Please refer from FIG. 1 to FIG. 4, the present disclosure provides a toy gun having embedded magazine, which includes a gun body 10, a top magazine cover 20 and a magazine assembly 30. It is to be noted that the toy gun also includes other components, for example a gunstock, a trigger, a gun bolt, a pulling rod, a handgrip, a supporter, a gun barrel and a front sight, etc. However, the aforesaid components are not disclosed in the detailed description of the disclosure, the aforesaid components are not shown in figures, and the description is omitted for brevity.

According to the present disclosure, each figure only shows an upper portion of the gun body, and a lower portion of the gun body is not shown. The present disclosure mainly relates to the upper portion of the gun body, thus the gun body 10 is used to represent the upper portion of the gun body. Moreover, the gun body 10 disclosed in the present disclosure is not limited to the upper portion of the whole gun body. In some embodiments, the gun body 10 is divided into a front segment 11 and a rear segment 12. A bore is defined in the front segment 11, and a receiver (in other words, a chamber) is defined in the rear segment 12.

A bullet feeding slot 121 is disposed at a top end of the rear segment 12 of the gun body 10. The top magazine cover 20 is in an elongated shape, and one end thereof is pivotally connected to the gun body 10. In some embodiments, the top magazine cover 20 is pivotally connected to a top end of the gun body 10, and the pivotally connected location of the top magazine cover 20 is located between the front segment 11 and the rear segment 12 of the gun body 10, here is not intended to be limiting. For example, the top magazine cover 20 may be pivotally disposed at a lateral side of the gun body 10. An accommodating slot 21 and a first latching structure 22 are disposed on a lateral surface of the top magazine cover 20 facing the gun body 10. The first latching structure 22 is located at one side of the accommodating slot 21. In some embodiments, the accommodating slot 21 is also in an elongated shape corresponding to the top magazine cover 20, the first latching structure 22 is located at one end of the accommodating slot 21 away from the pivotally connected location of the top magazine cover 20, here is not intended to be limiting. For example, the first latching structure 22 may be located at one end of the accommodating slot 21 close to the pivotally connected location of the top magazine cover 20.

The magazine assembly 30 is detachably disposed in the accommodating slot 21. The magazine assembly 30 includes a main body 31. The main body 31 is used to be loaded with a plurality of bullets (not shown in figures). A bullet discharging funnel 313 is disposed at one side of the main body 31 away from the top magazine cover 20. The main body 31 is disposed with a second latching structure 32. The second latching structure 32 is correspondingly latched with the first latching structure 22. In some embodiments, the first latching structure 22 is a fastening slot. The second latching structure 32 is a protrusion. The protrusion is correspondingly fastened with the fastening slot, thus the magazine assembly 30 is prevented from being easily released, when the magazine assembly 30 is disposed in the accommodating slot 21, to achieve a blocking effect. The present disclosure is not limited to aforementioned description, for example the first latching structure 22 may be a protrusion facing the accommodating slot 21, the second latching structure 32 may be a fastening slot, the fastening slot is correspondingly fastened with the protrusion, thus the blocking effect may also be provided to prevent the magazine assembly 30 from being easily detached from the accommodating slot 21.

Please refer to FIG. 1, FIG. 3, FIG. 4, FIG. 5, FIG. 6, and FIG. 7, when the top magazine cover 20 pivotally rotates from top to down to cover top of the gun body 10, the bullet discharging funnel 313 is correspondingly accommodated in the bullet feeding slot 121, thus the bullets are supplied to the chamber in the rear segment 12 of the gun body 10.

Figure 3:
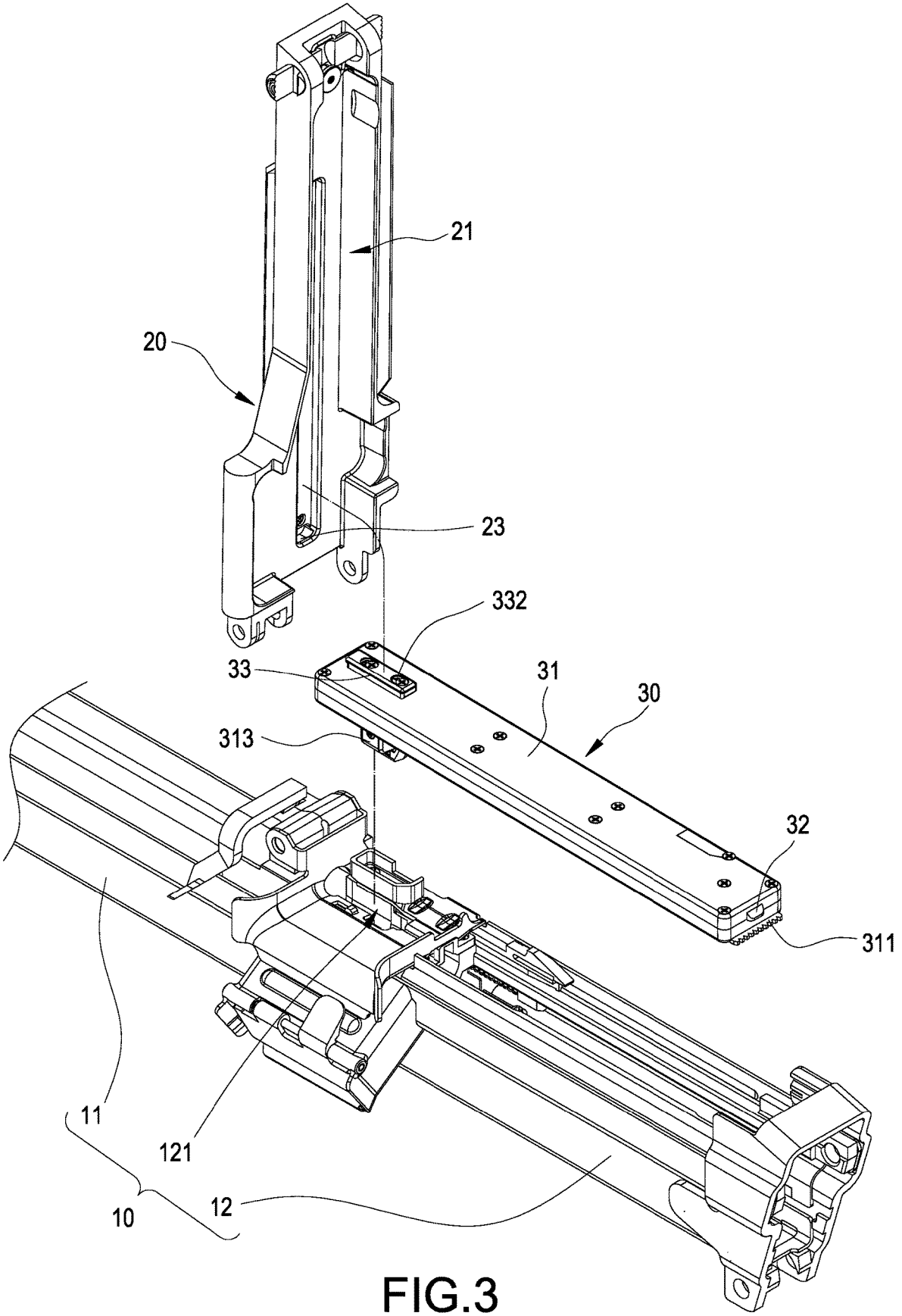
FIG. 3 is a perspective exploded view according to the present disclosure.

Please refer to FIG. 3, the main body 31 is convexly disposed with a pulling piece 311. The pulling piece 311 is extended from one side of the main body 31 away from the top magazine cover 20 (in other words, one side of the main body 31 facing the gun body 10), thus a user may apply a force to pull the main body 31 out from the accommodating slot 21. In some embodiments, the pulling piece 311 and the second latching structure 32 are disposed at the same side surface, in other words, the pulling piece 311 and the second latching structure 32 are both located at one end of the main body 31 away from the pivotally connected location of the top magazine cover 20. The pulling piece 311 of the present disclosure is not limited to the aforesaid arrangement, for example the pulling piece 311 may be extended toward a direction away from the second latching structure 32, in other words, the pulling piece 311 is located at one end of the main body 31 close to the pivotally connected location of the top magazine cover 20. In some embodiments, the pulling piece 311 is in a rectangular shape and an edge thereof is formed in a teeth shape, thus the user may apply the force in an easier manner and an anti-skid effect is provided, here is not intended to be limiting. The pulling piece 311 may be designed in any desired shape according to actual needs.

Details are provided as follows. The magazine assembly 30 further includes a sliding block 33 formed as a rectangular member. A latching slot 23 arranged corresponding to the first latching structure 22 is disposed at one side of the top magazine cover 20 facing the gun body 10, in other words, the latching slot 23 and the first latching structure 22 are disposed at two ends of the accommodating slot 21. The sliding block 33 is disposed on the main body 31. The sliding block 33 is extended with a latching segment 331 protruding from the main body 31. The latching segment 331 is correspondingly latched with the latching slot 23 to achieve a latching and fastening effect, thus an advanced blocking effect is provided to prevent the magazine assembly 30 from being easily detached from the accommodating slot 21.

Figure 4:
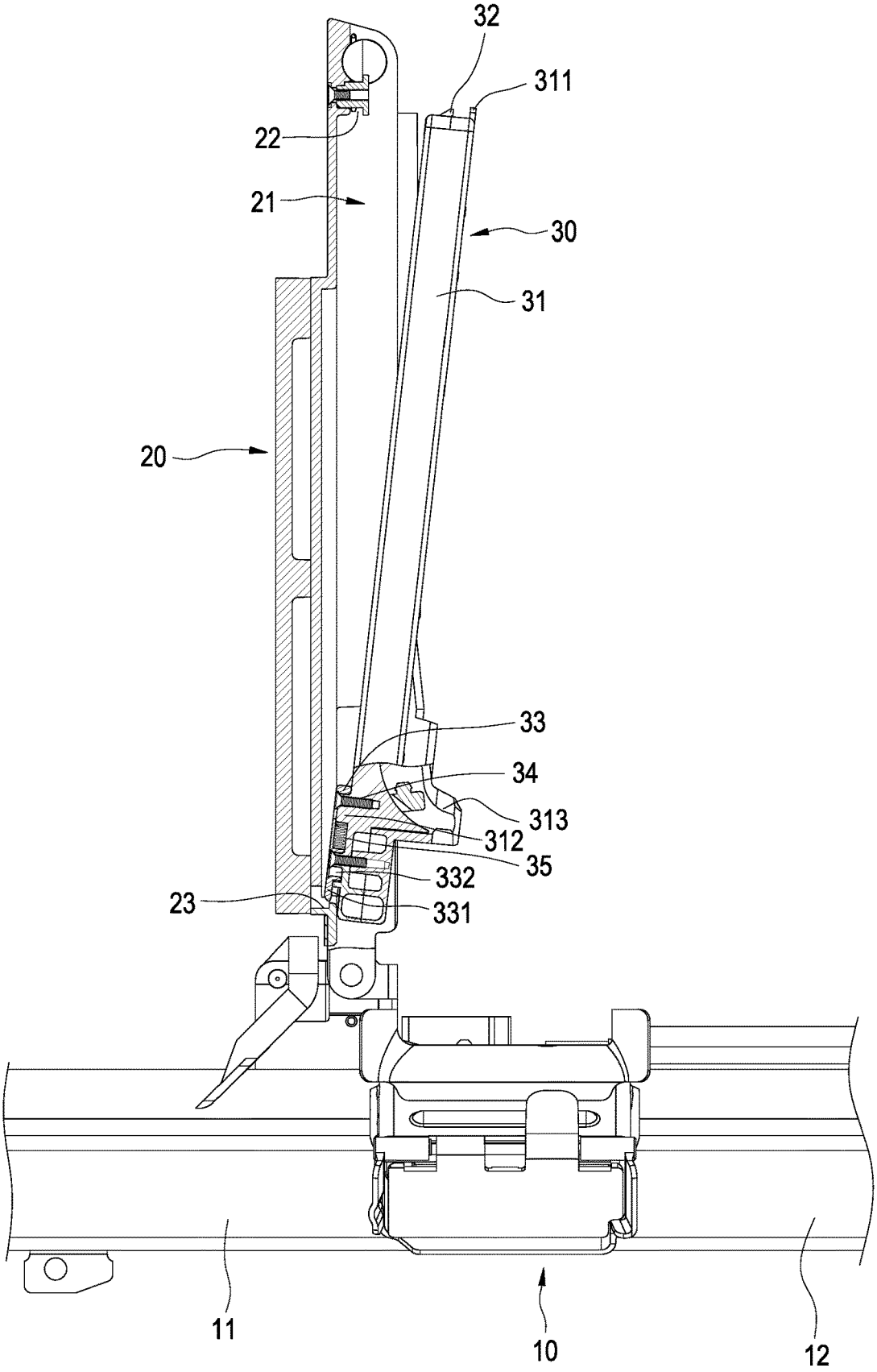
FIG. 4 is an assembling diagram showing the magazine assembly according to the present disclosure.

Please refer to FIG. 3 and FIG. 4, the magazine assembly 30 further includes at least one fastening member 34. At least one elongated hole 332 penetrating the sliding block 33 is formed. The elongated hole 332 is longitudinally extended along the sliding block 33 and formed in an elongated shape. A portion of the fastening member 34 passes through the elongated hole 332 and then is fastened on the main body 31. In some embodiments, the fastening member 34 is a screw bolt and locked with a screw hole (not labeled in figures) of the main body 31, here is not intended to be limiting. Accordingly, the sliding block 33 longitudinally slides on the main body 31 and is prevented from being released from the main body 31. In some embodiments, there are two fastening members 34 and two elongated holes 332, and the elongated holes 332 are longitudinally disposed in sequence along the sliding block 33, thus the sliding block 33 is effectively fastened on the main body 31 and prevented from rotating.

The magazine assembly 30 further includes an elastic member 35. A stopping block 312 is disposed on a lateral surface of the main body 31 facing the top magazine cover 20. The sliding block 33 covers an outer side of the stopping block 312. The elastic member 35 elastically abuts between the stopping block 312 and an inner wall of the sliding block 33. Substantially, a bottom end of the sliding block 33 is an inwardly recessed structure to make the sliding block 33 cover the outer side of the stopping block 312, and the inwardly recessed part at the bottom end of the sliding block 33 is formed with an abutting plate (not labeled in figures) abutting against the elastic member 35. In some embodiments, the elastic member 35 is a compression spring, here is not intended to be limiting. Accordingly, when an external force is applied to push the sliding block 33 to longitudinally slide away from the main body 31, the compression spring of the elastic member 35 is compressed. The sliding block 33 is pushed and recovered via an elastic force released by the compression spring when the external force is no longer applied to the sliding block 33. As such, the user may easily load the bullets in the magazine assembly 30.

Figure 5:
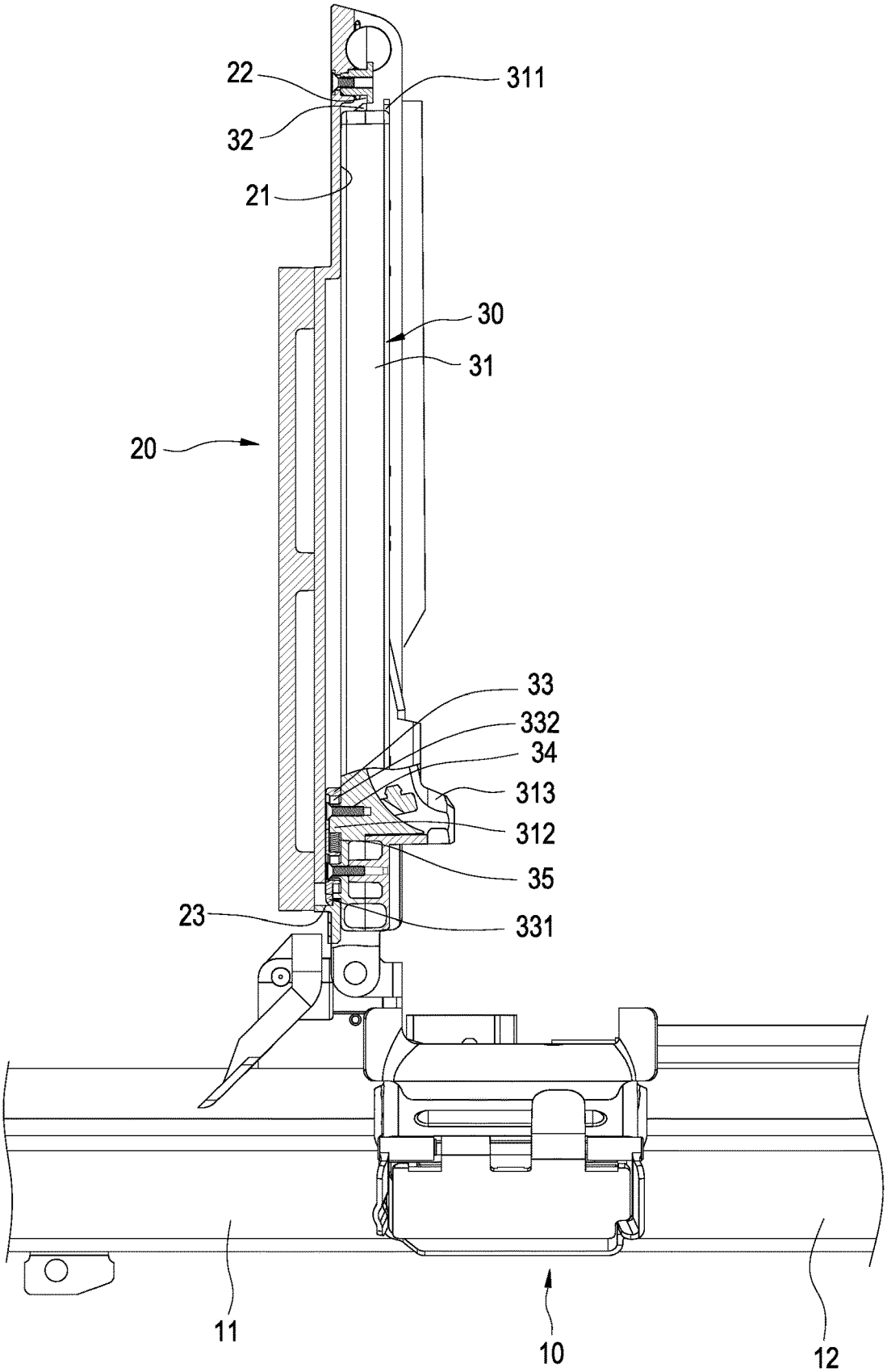
FIG. 5 is another assembling diagram showing the magazine assembly according to the present disclosure.
Figure 6:
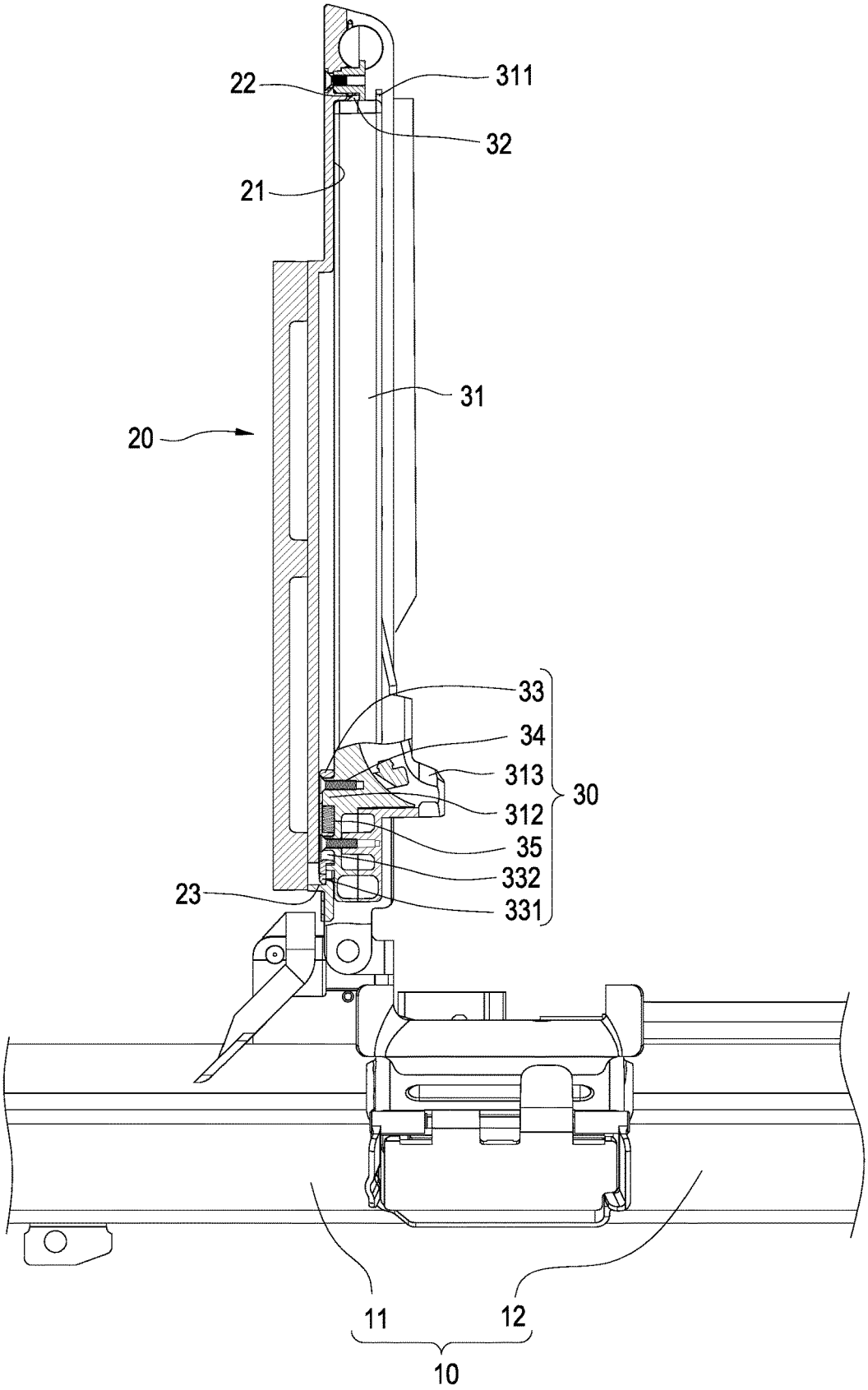
FIG. 6 is one another assembling diagram showing the magazine assembly according to the present disclosure.
Figure 7:
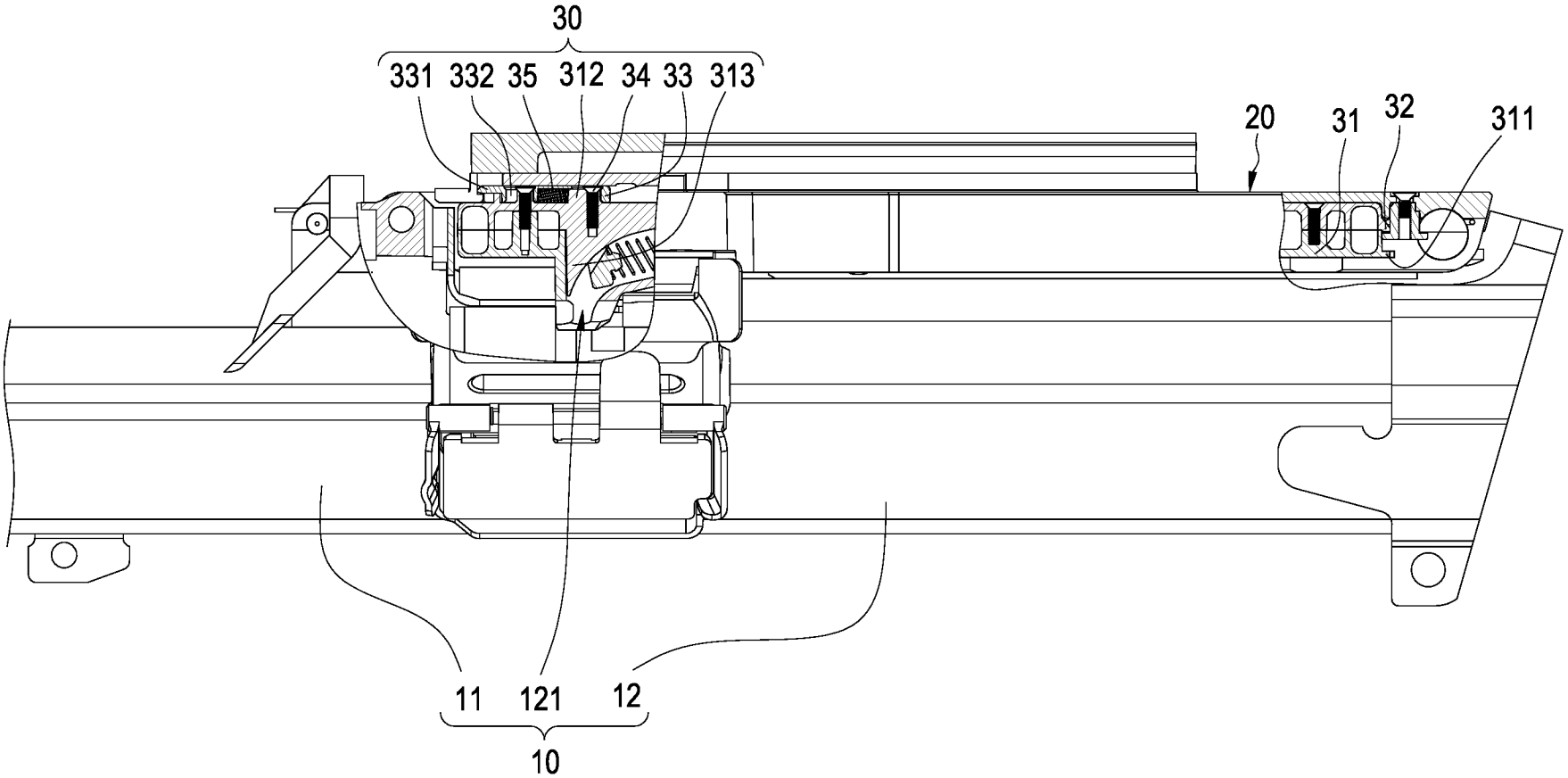
FIG. 7 is a partially lateral view according to the present disclosure.

Please refer to FIG. 4, FIG. 5, and FIG. 6, which are assembling diagrams showing the magazine assembly according to the present disclosure.

As shown in FIG. 4, after the top magazine cover 20 upwardly and pivotally rotates to be in an opened status, the sliding block 33 of the magazine assembly 30 is aimed at the latching slot 23 of the top magazine cover 20 to make the latching segment 331 of the sliding block 33 be obliquely latched in the latching slot 23.

As shown in FIG. 5, after the latching segment 331 is confirmed to be latched in the latching slot 23, the main body 31 of the magazine assembly 30 is pushed toward the pivotally connected location of the top magazine cover 20, at this moment the latching segment 331 of the sliding block 33 is latched with the latching slot 23, the main body 31 slides relative to the sliding block 33 toward the pivotally connected location of the top magazine cover 20 through the fastening member 34 sliding in the elongated hole 332, thus the main body 31 of the magazine assembly 30 is pushed into the accommodating slot 21 of the top magazine cover 20, and the stopping block 312 of the main body 31 abuts against the compression spring of the elastic member 35 to make the compression spring be compressed.

As shown in FIG. 6, after the main body 31 of the magazine assembly 30 is confirmed to be latched in the accommodating slot 21 of the top magazine cover 20, the force applied to the main body 31 is released to make the stopping block 312 be pushed via the elastic force of the compression spring of the elastic member 35, thus the main body 31 moves in the accommodating slot 21 toward a direction away from the pivotally connected location of the top magazine cover 20, the protrusion of the second latching structure 32 is correspondingly fastened with the fastening slot of the first latching structure 22, thus the assembly of the magazine assembly 30 is finished, and two ends of the magazine assembly 30 are both fastened in the top magazine cover 20.

When the magazine assembly 30 is desired to be detached, the pulling piece 311 is pressed to make the main body 31 move toward the pivotally connected location of the top magazine cover 20, the protrusion of the second latching structure 32 is released from the fastening slot of the first latching structure 22, meanwhile the pulling piece 311 is pulled to drive the main body 31 to be released from the accommodating slot 21 of the top magazine cover 20, thus the whole magazine assembly 30 is removed.

While this disclosure has been described by means of specific embodiments, numerous modifications and variations could be made thereto by those skilled in the art without departing from the scope and spirit of this disclosure set forth in the claims.

What is claimed is:

1. A toy gun, comprising:

a gun body, comprising a bullet feeding slot;

a top magazine cover, pivotally connected to a top end of the gun body and comprising an accommodating slot and a first latching structure disposed on a side thereof facing the gun body, the first latching structure located at a side of the accommodating slot; and a magazine assembly, detachably disposed in the accommodating slot and comprising a main body, the main body comprising a bullet discharging funnel disposed on a side away from the top magazine cover and a second latching structure correspondingly latched with the first latching structure;

wherein, when the top magazine cover pivotally rotates from top to down to cover top of the gun body, the magazine assembly is entirely hidden between the gun body and the top magazine cover, the bullet discharging funnel is correspondingly accommodated in the bullet feeding slot.

2. The toy gun according to claim 1, wherein the top magazine cover further comprises a latching slot arranged opposite to the first latching structure and disposed on the side of the magazine cover facing the gun body, the magazine assembly further comprises a sliding block disposed on the main body and extended with a latching segment protruding from the main body, and the latching segment is correspondingly latched with the latching slot.

3. The toy gun according to claim 2, wherein the magazine assembly further comprises a fastening member, the sliding block comprises an elongated hole, and the fastening member is fixed on the main body and passes through the elongated hole, accordingly the sliding block longitudinally slides on the main body.

4. The toy gun according to claim 3, wherein the magazine assembly further comprises an elastic member, the main body comprises a stopping block disposed on a side thereof facing the top magazine cover, the sliding block covers the stopping block, and the elastic member elastically abuts between the stopping block and an inner wall of the sliding block.

5. The toy gun according to claim 1, wherein the first latching structure comprises a fastening slot, the second latching structure comprises a protrusion, and the protrusion is correspondingly fastened with the fastening slot.

6. The toy gun according to claim 1, wherein the first latching structure comprises a protrusion, the second latching structure comprises a fastening slot, and the fastening slot is correspondingly fastened with the protrusion.

7. The toy gun according to claim 1, wherein the main body comprises a pulling piece, the pulling piece is extended from a side of the main body away from the top magazine cover and located at a same side surface with the second latching structure.

8. The toy gun according to claim 7, wherein an outer edge of the pulling piece is in a teeth shape.

9. The toy gun according to claim 1, wherein the main body comprises a pulling piece, and the pulling piece is extended from a side of the main body away from the top magazine cover and extended toward a direction away from the second latching structure.

10. The toy gun according to claim 9, wherein an outer edge of the pulling piece is in a teeth shape.

* * * * *